US010506362B1

(12) United States Patent
Gomes

(10) Patent No.: US 10,506,362 B1
(45) Date of Patent: Dec. 10, 2019

(54) DYNAMIC FOCUS FOR AUDIO AUGMENTED REALITY (AR)

(71) Applicant: BOSE CORPORATION, Framingham, MA (US)

(72) Inventor: Rodrigo Sartorio Gomes, Natick, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 16/153,519

(22) Filed: Oct. 5, 2018

(51) Int. Cl.

| | |
|---|---|
| ***H04S 7/00*** | (2006.01) |
| ***G10L 21/0208*** | (2013.01) |
| ***H04R 5/033*** | (2006.01) |
| ***H04R 5/04*** | (2006.01) |

(52) U.S. Cl.
CPC ..... *H04S 7/304* (2013.01); *G10L 21/0208* (2013.01); *H04R 5/033* (2013.01); *H04R 5/04* (2013.01); *H04S 2400/11* (2013.01); *H04S 2400/13* (2013.01)

(58) Field of Classification Search
CPC ..... H04R 5/04; H04R 5/033; H04S 2400/11; H04S 2400/13; H04S 7/304; G10L 21/0208
See application file for complete search history.

(56) References Cited

U.S. PATENT DOCUMENTS

| | | | | |
|---|---|---|---|---|
| 10,194,259 | B1 * | 1/2019 | Martin | H04S 7/304 |
| 2012/0194419 | A1 * | 8/2012 | Osterhout | G02B 27/0093 345/156 |
| 2016/0043699 | A1 * | 2/2016 | Sawa | H04R 1/406 381/57 |

* cited by examiner

*Primary Examiner* — Regina N Holder
(74) *Attorney, Agent, or Firm* — Patterson + Sheridan, LLP

(57) ABSTRACT

A method is provided for operating a wearable audio device. At least one point of interest is detected in a vicinity of a user wearing the audio device. In response to the detection, audibility of sounds received in a direction of the at least one point of interest is improved, while attenuating sounds received in at least one other direction. The improved sounds are output for delivering by the audio device to at least one ear of the user.

20 Claims, 6 Drawing Sheets

DYNAMIC FOCUS FOR AUDIO AUGMENTED REALITY (AR)

FIELD

Aspects of the disclosure generally relate to improving audibility of real world sounds, and more specifically to techniques for dynamically focusing on certain sounds for an enhanced audio augmented reality (AR) experience for a user.

BACKGROUND

Various technologies have been developed for wearable audio devices to enhance the audio experience for a user. Certain headphone devices (e.g., Bose® Hearphones®) use active noise cancellation and directional microphone arrays to focus on sounds received from a desired direction while dampening sounds from all other directions. These headphone devices essentially allow focusing on certain sounds while attenuating all other sounds allowing a user to hear certain sounds clearly in noisy environments.

Audio augmented reality or audio AR (e.g., Bose® AR) is another technology that adds an audible layer of information and experiences based on what a user is looking at to enhance the user's audio experience. This audible layer of information is generally delivered to the user via some kind of a wearable audio device. Various sensors are used to track a head motion of the user to determine a direction in which a user is looking. Further, Global Positioning System (GPS) is used to track a location of the user. The head tracking and location information is used by an audio AR platform to aggregate real-time content relevant to what the user is looking at, which is streamed to the user's ears instantly. For example, the audio AR platform may enhance a user's travel experience by simulating historic events at landmarks as the user views them, streaming a renowned speech of a famous person in a monument's statue the user is looking at, or provide information on which way to turn towards a departure gate while checking in at the airport.

SUMMARY

All examples and features mentioned herein can be combined in any technically possible manner.

Aspects of the present disclosure provide a method for operating a wearable audio device. The method generally includes detecting at least one point of interest in a vicinity of a user wearing the audio device; improving audibility, in response to the detection, of sounds received in a direction of the at least one point of interest while attenuating sounds received in at least one other direction; and outputting at least the improved sounds for delivering by the audio device to at least one ear of the user.

In an aspect, improving the audibility of the sounds received in the direction of the at least one detected point of interest includes focusing one or more microphones of the audio device in the direction of the at least one point of interest to receive the sounds emanating from the point of interest, while attenuating sounds in at least one unfocused direction.

In an aspect, detecting the at least one point of interest includes receiving information regarding a first position of the user, receiving information regarding a second position of the at least one point of interest, and determining, based on the received first and second positions, that the user is in the vicinity of the at least one point of interest. In an aspect, the first position of the user includes a Global Positioning System (GPS) coordinates of the user's physical location and an orientation of the user's head.

In an aspect, the method further includes receiving pre-recorded audio associated with the at least one point of interest, wherein outputting the improved sounds further includes outputting the pre-recorded audio for delivering by the audio device along with the improved sounds to the at least one ear of the user. In an aspect, the method further includes receiving configuration information configuring the outputting of the pre-recorded audio and the improved sounds, and outputting the pre-recorded audio and the improved sounds based on the configuration. In an aspect, the outputting includes intermittently outputting the pre-recorded audio, wherein the improved sounds are outputted when the pre-recorded is not outputted. In an aspect, the outputting includes outputting the improved sounds at a reduced volume when the pre-recorded audio is being outputted.

In an aspect, the method further includes receiving head tracking information indicating a head position of the user, wherein at least a portion of the audio device is coupled to the head of the user and an orientation of the audio device changes with the head position of the user; and setting a direction relative to the audio device for the improving audibility of the sounds based on the received head tracking information. In an aspect, the setting includes changing the direction relative to the audio device based on the head tracking information to maintain alignment with the direction of the point of interest.

In an aspect, the method further includes receiving user preferences relating to a set of points of interests, and selecting, based on the user preferences, the at least one point of interest for the detecting.

Aspects of the present disclosure provide a wearable audio device. The wearable audio device generally includes a transceiver configured to transmit and receive signals; a set of microphones for receiving sound in an environment external to the audio device; and a processing unit. The processing unit is generally configured to detect at least one point of interest in a vicinity of a user wearing the audio device; and improve audibility, in response to the detection, of a portion of the sound received in a direction of the at least one point of interest while fading out one or more remaining portions of the sound received in at least one other direction. The wearable audio device further includes at least one speaker for delivering sounds to the ears of the user, wherein the improved sounds are delivered by the at least one speaker to at least one ear of the user.

In an aspect, the processing unit is configured to improve audibility of the portion of the sound by focusing the set of microphones in the direction of the at least one point of interest to receive the sounds emanating from the point of interest, while attenuating sounds in at least one unfocused direction.

In an aspect, the transceiver is configured to receive information regarding a first position of the audio device, and receive information regarding a second position of the at least one point of interest, wherein the processing unit is configured to detect the at least one point of interest by determining, based on the received first and second positions, that the user is in the vicinity of the at least one point of interest.

In an aspect, the transceiver is configured to receive pre-recorded audio associated with the at least one point of interest, wherein the at least one speaker is configured to deliver the pre-recorded audio along with the improved sounds to the at least one ear of the user.

In an aspect, at least a portion of the audio device is coupled to the head of the user and an orientation of the audio device changes with a head position of the user. In this context, the device further includes at least one sensor for tracking an orientation of the audio device, wherein the processing unit sets a direction relative to the audio device for the improving audibility of the sounds based on the tracking.

Aspects of the present disclosure provide a wearable audio device. The wearable audio device generally includes a set of microphones for receiving sound in an environment external to the audio device, at least one processor and a memory coupled to the at least one processor. The at least one processor is generally configured to detect at least one point of interest in a vicinity of a user wearing the audio device; improve audibility, in response to the detection, of sounds received in a direction of the at least one point of interest while fading out sounds received in at least one other direction; receive pre-recorded audio associated with the at least one point of interest; and output the improved sounds and the pre-recorded audio for delivering by the audio device to at least one ear of the user.

In an aspect, the at least one processor is configured to improve audibility of the sounds by focusing the set of microphones in the direction of the at least one point of interest to receive the sounds emanating from the point of interest, while attenuating sounds in at least one unfocused direction.

In an aspect, the at least one processor is configured to detect the at least one point of interest by receiving information regarding a first position of the user; receiving information regarding a second position of the at least one point of interest; and determining, based on the received first and second positions, that the user is in the vicinity of the at least one point of interest.

In an aspect, the at least one processor is further configured to receive configuration information configuring the outputting of the pre-recorded audio and the improved sounds, and output the pre-recorded audio and the improved sounds based on the configuration.

In an aspect, the at least one processor is further configured to receive head tracking information indicating a head position of the user, wherein at least a portion of the audio device is coupled to the head of the user and an orientation of the audio device changes with the head position of the user; and set a direction relative to the audio device for the improving audibility of the sounds based on the received head tracking information.

DETAILED DESCRIPTION

Aspects of the present disclosure provide techniques for using audio AR with dynamic audio focusing to provide an enhanced real-time experience to a user. In certain aspects, the techniques include changing a user's physical world audio focus based on virtual audio markers or points of interest to focus on real world sounds emanating from a direction of an audio marker. In certain aspects, the real world sounds from an audio marker are overlaid with pre-recorded digital sounds, thus combining a physical experience with digital experience to provide a unique and immersive experience to the user.

For example, if a user wearing audio AR headphones in accordance with aspects of the present disclosure is walking past Pike Place Fisher's market in Seattle, Wash., in the United States, an AR application (e.g., a travel application) running on the user's smart phone (in communication with the AR headphones) may detect proximity of the user to the market, and in response, the headphones may change a directionality of audio focus to align with the direction of the market so that the user may hear the real time sounds from the market more clearly. Additionally, pre-recorded digital information or other audio experiences associated with the market (e.g., virtual audio markers) may be overlaid on the real world sounds and streamed to the user's ears to augment the real-life sounds from the market.

Enabling a user to hear real world audio as it exists around an available audio marker helps give a more immersive audio AR experience to the user which may only be realized by combining physical presence in the vicinity of the audio marker and techniques for improving audibility of the sounds around the audio marker in accordance with aspects of the present disclosure. The real world audio ensures that no two experiences are alike, which is challenging to replicate in a fully digital simulation.

Figure 1:
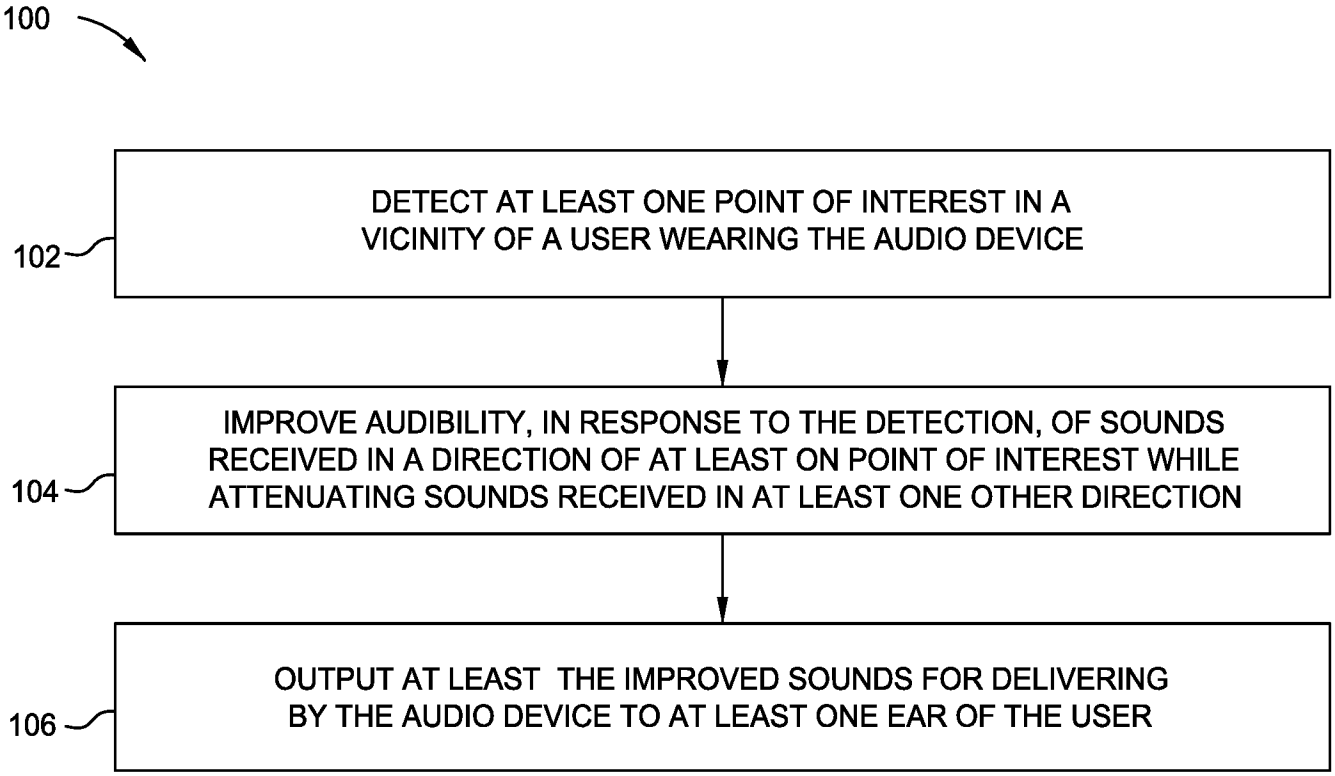
FIG. 1 illustrates example operations for dynamic audio focusing based on availability of points of interests, in accordance with certain aspects of the present disclosure.

FIG. 1 illustrates example operations 100 for dynamic audio focusing based on availability of points of interests, in accordance with certain aspects of the present disclosure. In an aspect, operations 100 may be performed by a wearable audio device such as audio headphones. Aspects and implementations disclosed herein may be applicable to a wide variety of audio systems, such as wearable audio devices in various form factors. Unless specified otherwise, the term wearable audio device, as used in this document, includes headphones and various other types of personal audio devices such as head, shoulder or body-worn acoustic devices (e.g., audio eyeglasses or other head-mounted audio devices) that include one or more acoustic drivers to produce sound, with or without contacting the ears of a user. It should be noted that although specific implementations of speaker systems primarily serving the purpose of acoustically outputting audio are presented with some degree of detail, such presentations of specific implementations are intended to facilitate understanding through provision of examples and should not be taken as limiting either the scope of disclosure or the scope of claim coverage.

Operations 100 begin, at 102 by detecting at least one point of interest in a vicinity of a user wearing the audio device. The point of interest could be a place near the user with an associated virtual audio marker.

At 104, in response to detecting the at least one point of interest, audibility of sounds received in a direction of the detected at least one point of interest is improved, while attenuating sounds received in at least one other direction.

At 106, at least the improved sounds are output for delivering by an electro-acoustic transducer of the audio device to at least one ear of the user. In some examples, the improved sounds are combined with sounds associated with a virtual audio marker for simultaneous output by an electro-acoustic transducer of the audio device to at least one ear of the user.

Figure 2:
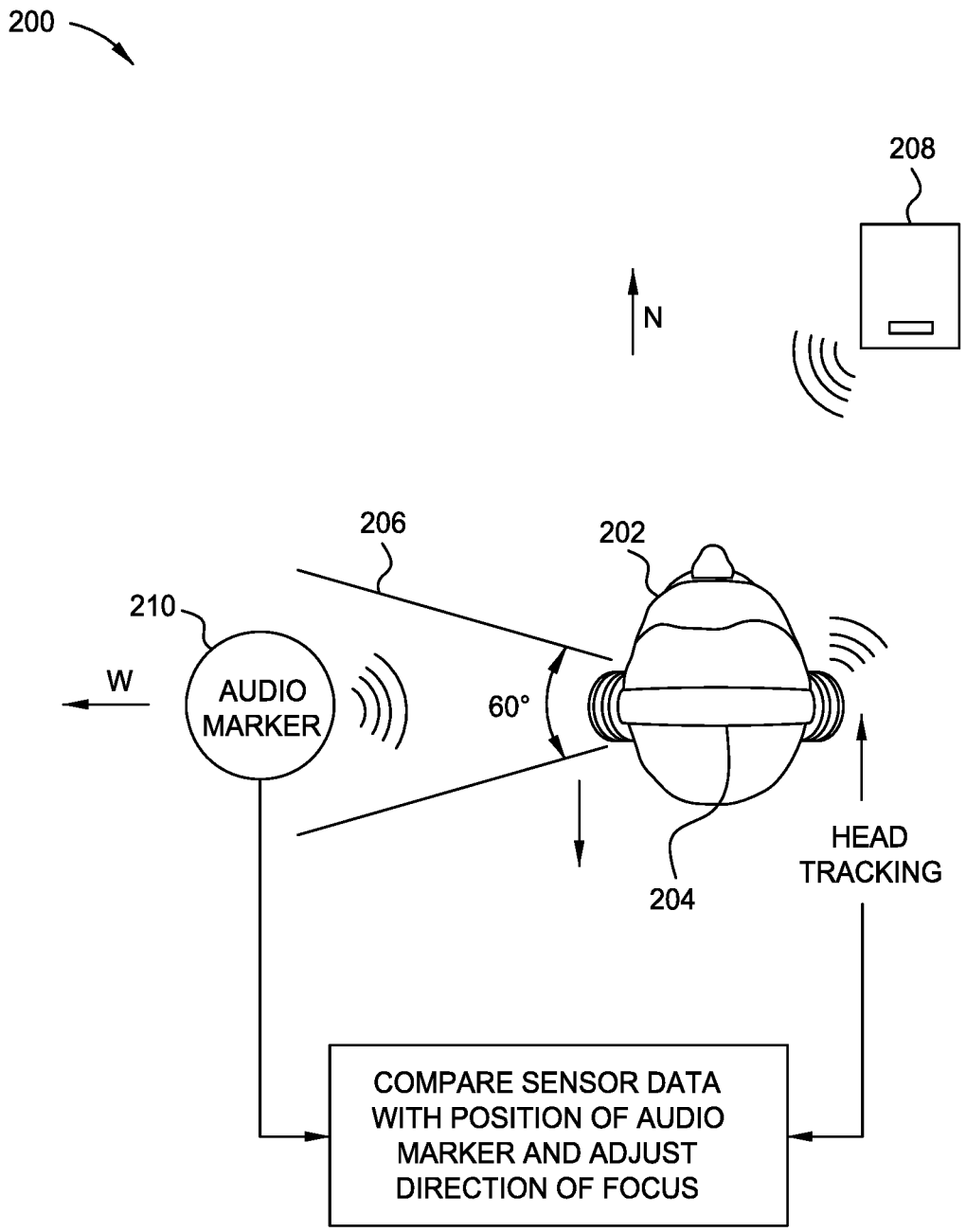
FIG. 2 illustrates an example system for dynamic audio focusing based on availability of points of interests, in accordance with certain aspects of the present disclosure.

FIG. 2 illustrates an example system 200 for dynamic audio focusing based on availability of points of interests, in accordance with certain aspects of the present disclosure.

As shown, system 200 includes a user 202 wearing audio headphones 204. In an aspect, the audio headphones 204 include one or more microphones for receiving sounds in an environment external to the headphones 204. The headphones 204 further include or are connected to a processing unit configured to detect points of interests and improve audibility of sounds received from the direction of detected points of interests. The headphones 204 further include at least one speaker (e.g., a speaker in each ear cup of the headphones 204) for delivering sounds to at least one ear of the user 202.

In an aspect, the audio headphones 204 are capable of improving audibility of sounds received from certain directions. For example, the audio headphones 204 include directional microphone arrays (e.g., in each ear cup or earbud of the headphones) and/or active noise cancelling module(s) that may focus on sounds received from one or more directions relative to the headphones 204. In an aspect, in order to improve audibility of sounds received from a desired direction, the headphones 204 may focus one or more microphones towards the desired direction. In addition, the headphones 204 may attenuate sounds received from all other (e.g., undesired) directions by using active noise cancelling. In an alternative aspect, the headphone microphones may not have directional capability and focusing on sounds received from the desired direction may merely include attenuating sounds from all other directions.

In certain aspects, the audio headphones 204 may focus on sounds received from within a virtual audio cone. In an aspect, the audio headphones 204 may focus on sounds in different audio cone sizes, wherein a size of each audio cone is determined by an angle of the cone formed at the headphones 204. For example, the audio headphones 204 may focus on sounds received from audio cones with angles of 20°, 40°, 60°, 80°, 120°, 180°, 270°, or 360°. As shown in FIG. 2, the audio headphones 204 are focusing on sounds received from the west direction (identified by W) in a 60° audio cone 206. The headphones 204 improve audibility of most or all sounds received from within the audio cone 206. In an aspect, the headphones 204 attenuate all sounds received from outside the audio cone 206. In an aspect, the headphones may simultaneously focus on multiple audio cones in different directions and may overlay the sounds received from the multiple focused cones.

In certain aspects, as shown in FIG. 2, the audio headphones 204 may be connected (e.g., wired or wirelessly) to a portable device 208 that may be carried by the user 202. In an aspect, the headphones 204 include a transceiver (e.g., a wireless transceiver) that communicates with the portable device 208 using a known protocol (e.g., Bluetooth®). In an aspect, the portable device 208 may include a smart phone running an audio AR application configured to control the audio AR experience for the user 202. In an aspect, the portable device 208 includes Global Positioning System (GPS) capability and may determine a position of the portable device, and thus, the user 202 carrying the portable device 208 and the headphones 204 worn by the user 202, based on GPS coordinates. For example, the portable device may determine the position by mapping GPS coordinates on a map. The GPS capability could also or alternatively be included in the audio headphones 204.

In an aspect, the portable device may be configured to determine positions of pre-configured points of interests in the vicinity of the user. In an aspect, a point of interest includes a virtual audio marker or pin identifying a desired physical location on a map. The audio marker may be defined by GPS coordinates. FIG. 2 shows an audio marker 210 located towards the west direction (indicated by W). In an aspect, the audio AR application may store GPS locations of pre-configured points of interests. The application may continuously track the user's position relative to the audio markers and may determine that the user is in the vicinity of a particular audio marker when the user moves closer to the position of the audio marker. In an aspect, how close the user needs to get to an audio marker to trigger proximity may be configured using the AR application. In an aspect, the proximity trigger may be configured independently for each audio marker. For example, the audio marker 210 shown in FIG. 2 is close enough to be determined as being in the vicinity of the user according to a configuration associated with the audio marker 210. In an aspect, proximity triggers for audio markers located in dense areas may be set to smaller distances from the user 202 (e.g., 10-15 feet) as compared to audio markers located in larger less dense areas where the proximity triggers are set to larger distances (e.g., hundreds of feet or even miles) from the user 202. Thus, the user 202 walking through a downtown area may need to get fairly close to audio markers to trigger proximity. On the other hand if the user is driving through the countryside or a mountainous region, proximity to audio markers (e.g., peaks of mountains, natural formations etc.) may be triggered even if the user is at much longer distances from the audio markers.

In certain aspects, the audio headphones 204 may include various sensors (e.g., magnetometer, gyroscope, accelerometer etc.) that help track an orientation of the user's head, assuming that the user is wearing the headphones as instructed by the manufacturer. In an aspect, since an orientation of the headphones 204 changes with the orientation of the user 202, the headphones may track an orientation of the user's head and determine a direction in which the user is looking at any time.

In certain aspects, when proximity of the user to a configured audio marker is detected (e.g., by the AR application running on the portable device 208), the audio headphones, based on position information of the audio marker (e.g., position of the audio marker relative to the user's position) received from the portable device and head tracking information indicating a head orientation of the user, sets a direction of focus relative to the audio headphones 204 (or user's head) to focus on sounds originating from the direction of the audio marker. In an aspect, the AR application transmits other configuration information including information regarding when to focus, a duration of focus, and an audio cone size to use for the focus. The configuration information may further include information regarding whether to attenuate sounds received outside the cone of focus and to what extent. As shown in FIG. 2, the headphones 204 are focusing on sounds received from the direction of the audio marker 210 with a 60° cone of focus centered on the audio marker 210. As shown, the user is looking towards the north direction which may be indicated by head tracking. In this case, the headphones, based on the position of the audio marker 210 received from the portable device 208 and head tracking information, decides to direct the cone of focus 206 towards the left of the user 202 in order to focus on sounds around the audio marker 210.

In the example system 200, the portable device 208 (or the headphones 204 in the case of the GPS capability being located within the headphones) continuously tracks the user's position relative to one or more audio markers (including audio marker 210) configured for the user (e.g., via the AR application), and triggers a proximity alert when the user moves within a configured distance of the audio marker 210. Once the proximity alert is triggered for the audio marker 210, the portable device 208 transmits a position of the audio marker 210 relative to the user's position and additional configuration information including an audio cone size to use (e.g., cone angle of 40° at the headphones 204), when to focus, a duration of focus etc. The headphones 204 also determine that the user is looking towards the northerly direction based on head tracking as explained above. The headphones 204, based on the received position information of the audio marker 210 and head tracking information, determines a direction of focus to be used relative to the headphones in order to align with the direction of the audio marker 210. The headphones, based on the received additional configuration information, then focus on sounds received from the direction of the audio marker 210 using a 60° audio cone centered on the audio marker 210.

In certain aspects, today's smart phones have fairly advanced processing power and large storage. The headphones may benefit by moving most of the processing to the smart phone. This may allow the headphones to have a less complex and a more compact construction. Further, reduced processing by the headphones means fewer processing resources and storage space needs to be made available in the headphones, which may reduce the overall cost of the headphones. Additionally, the reduced processing may lead to lower power consumption and longer battery life. Thus, in an aspect, all the processing related to determining a position of the audio marker, orientation of the user's head, and setting a direction of focus relative to the headphones 204 may be performed by the portable device 208. For example, the headphones 204 may only include electronic components necessary for head tracking and audio focusing. The headphones 204 may send the head tracking information to the portable device and the portable device may determine a direction of focus to be set to align with the direction of the audio marker. The portable device transmits the information regarding the determined direction of focus to the headphones 204. The headphones 204, based on the received direction of focus, focus on sounds received from the direction of the audio marker. Conversely, as technology advances and the processing capability of headphones advances, all of the processing related to determining a position of the audio marker, orientation of the user's head, and setting a direction of focus relative to the headphones 204 may be performed by the headphones 204 themselves.

For example, if a user wearing the audio headphones (e.g., headphones 204) is walking past Pike Place Fisher's market in Seattle, Wash., in the United States, an AR application (e.g., a travel application) running on the user's smart phone or headphones may detect an audio marker associated with the market and trigger a proximity alert when the user moves within a configured distance from the market. The AR application and/or the headphones may sense the direction difference between the user's walking/facing direction and the position of the market, and may change the directionality of focus of the headphones to align with the direction of the market, so that the user may hear the real time sounds from the market more clearly.

In certain aspects, the audio headphones may change a directionality of audio focus based on availability of audio markers in the vicinity of the user. For example, if the user wearing the headphones is walking in the northerly direction and has the directionality of focus set in a 60° cone of focus towards the user's walking direction, and an audio marker is detected in the westerly direction, the headphones may automatically change the directionality of focus to align with the direction of the detected audio marker, for example, in a 40° (or other angle) cone of focus.

Figure 3A:
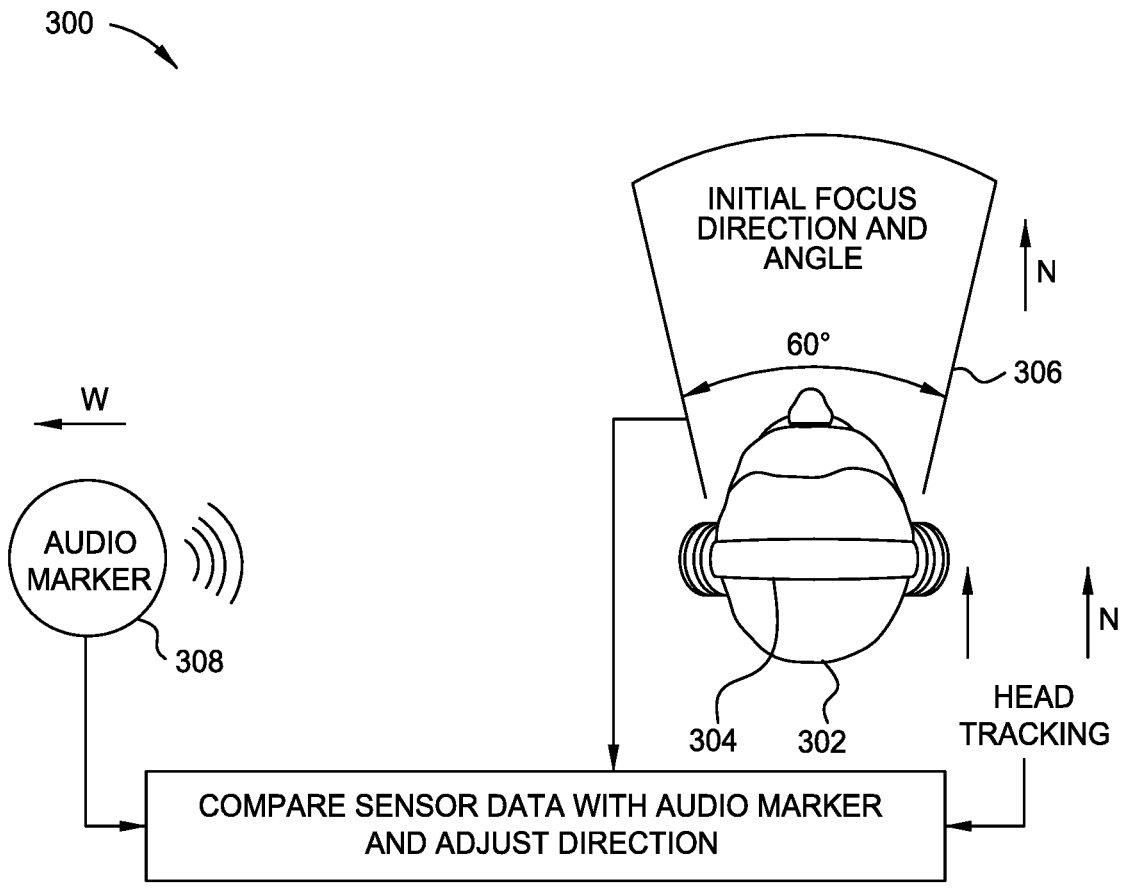
FIGS. 3A, 3B and 3C illustrate an example of a change in directionality of audio focus based on availability of audio markers, in accordance with certain aspects of the present disclosure.
Figure 3B:
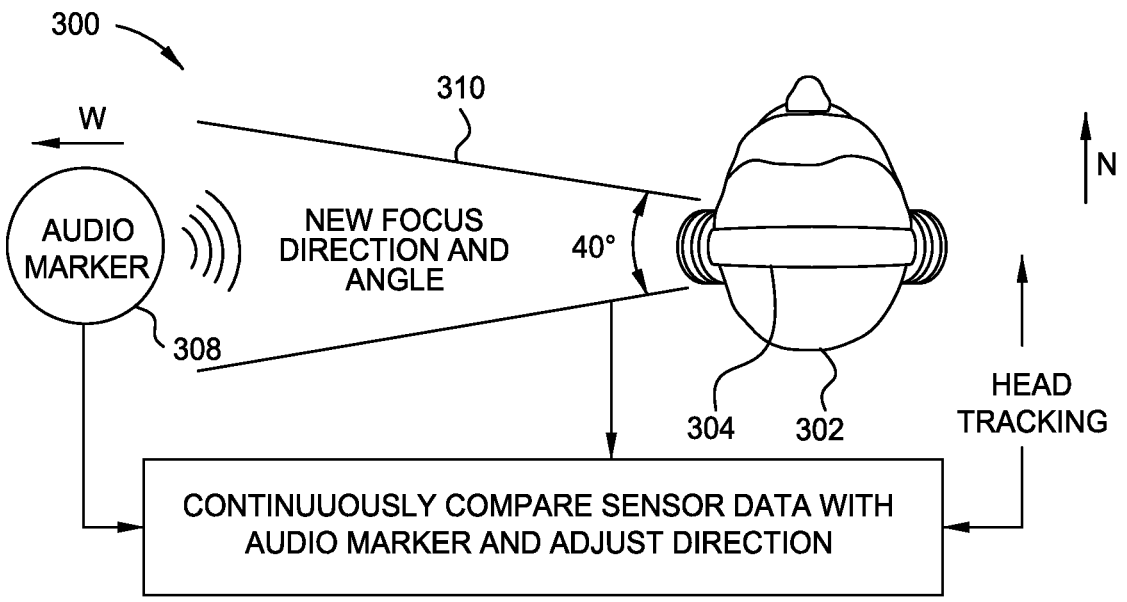
Figure 3C:
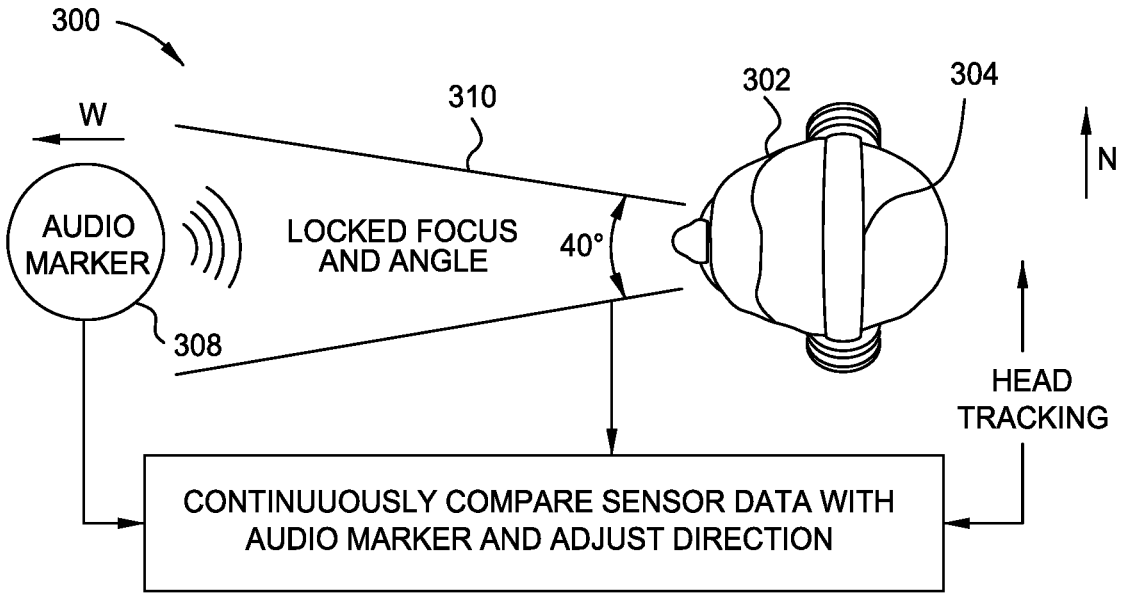

FIGS. 3A, 3B and 3C illustrate an example 300 of a change in directionality of audio focus based on availability of audio markers, in accordance with certain aspects of the present disclosure.

As shown in FIG. 3A, a user 302 is wearing audio headphones 304 and facing in the northerly direction. As discussed above, the user's head orientation may be detected by way of head tracking using one or more sensors built into the headphones 304. As shown, the audio headphones 304 are focused in a 60° cone 306 centered around the northerly direction in which the user is looking. In an aspect, the initial direction and angle of the cone 306 may be set by the user using an AR application running on a portable device connected to the headphones 304 or on the headphones 204 themselves. An audio marker 308 is located on the left of the user 302 towards the westerly direction. In an aspect, the headphones 304, the AR application, or a combination thereof may track one or more pre-configured audio markers and trigger a proximity alert when the user moves within a configured distance of an audio marker (e.g., audio marker 308). Once, the proximity alert is triggered, the headphones 304, the AR application, or a combination thereof compare the sensor data indicating the user's head orientation with the position of the detected audio marker 308, and determine a direction of focus relative to the headphones 304 that needs to be set for aligning with the direction of the audio marker 308.

As shown in FIG. 3B, the directionality of focus is changed from the initial focus direction to a new focus direction that is aligned with the direction of the audio marker 308. As shown in FIG. 3B, the audio headphones 304 are now focused in a 40° cone 310 towards the direction of the audio marker 308, in order to improve audibility of sounds received from around the audio marker 308.

In an aspect, once the directionality of focus is changed to align with the direction of the audio marker 308, the focus is locked such that the headphones continue to focus on the audio marker 308 irrespective of changes in the user's head orientation. For example, as shown in FIG. 3C, the user's head is now turned to face the audio marker. However, the directionality of focus remains aligned with the direction of the audio marker 308. In an aspect, to implement the locked focus, the headphones 304, the AR application, or a combination thereof may continuously or periodically compare the sensor data indicating the user's head orientation with the position of the audio marker 308, and continuously or periodically adjust the direction of focus relative to the headphones 304 to stay aligned with the direction of the audio marker 308.

In certain aspects, if another audio marker is detected later, the headphones 304 may change the directionality of focus from audio marker 308 to align with the direction of the newly detected audio marker. Additionally, as discussed above, the headphones 304 may focus on more than one audio markers at one time and may overlay sounds from the focused audio markers.

For example, the user 302 wearing the audio headphones 304 and walking past Pike Place Fisher's market in Seattle, Wash., in the United States, may have set an initial direction of focus to align with a direction in which the user is looking. An AR application (e.g., a travel application) running on the user's smart phone or headphones 304 may detect an audio marker associated with the market to the left of the user and trigger a proximity alert when the user moves within a configured distance from the market. The AR application and/or the headphones may sense the direction difference between the user's walking/facing direction and the position of the market, and may change the directionality of focus of the headphones from the initial direction to align with the direction of the market, so that the user may hear the real time sounds from the market more clearly. The user, in response to hearing the real time sounds from the newly focused direction, may turn his/her head in the direction of the market to view the market. However, the directionality of focus remains aligned with the direction of the audio marker 308 so that the user continues to hear the enhanced real time sounds from around the market that matches with what the user is looking at.

In certain aspects, pre-recorded audio may be overlaid on the improved/focused real world sounds from around an audio marker to enhance the user's AR experience. For example, if a user wearing the audio headphones 304 is walking past Pike Place Fisher's market in Seattle, Wash., in the United States, an AR application (e.g., a travel application) running on the user's smart phone or headphones 304 may detect an audio marker associated with the market and trigger a proximity alert when the user moves within a configured distance from the market. The AR application and/or the headphones may sense the direction difference between the user's walking/facing direction and the position of the market, and may change the directionality of focus of the headphones to align with the direction of the market, so that the user may hear the real time sounds from the market more clearly. Additionally, the AR application may overlay pre-recorded digital audio on the improved/focused real world sounds of the fish market to enhance the user's overall experience, instead of trying to replicate the entire experience via simulated audio. Thus, a physical experience is combined with digital experience to provide the user with a unique experience that may not be created by simulation alone.

In certain aspects, the overlaying of the pre-recorded content on the improved real world sounds may be configured and controlled using the AR application. In an aspect, overlaying of the pre-recorded content on the real world sounds may include, outputting the real world sounds when pre-recorded content is not being streamed to the user's ears. In an alternative aspect, the real word sounds may be output at a reduced volume when the pre-recorded content is being streamed to the user's ears. In an alternative aspect, the real world sounds and pre-recorded content may be mixed for simultaneous output to the user's ears.

In certain aspects, the audio AR application may be used to customize the AR experience for a user. In an aspect, the AR application may configure where and how the headphones are focused and what pre-recorded content is overlaid on real world sounds. For example, the headphones may be configured via the AR application to focus on certain configured audio markers, how long to focus on a particular audio marker, when to change focus to a different audio marker, when to overlay digital information (e.g., by interrupting the real world focused sounds, by reducing the volume of the real world focused sounds, or by mixing the digital information with the real world focused sounds etc.). In one example, as the user walks by an audio marker, the headphones may be configured to first provide digital information regarding the audio marker and thereafter focus the microphones on the marker to improve real world sounds, and maintain focus lock regardless of the user's head orientation.

In an aspect, the user may control at least a portion of the AR experience using the AR application. In an aspect, the user may specify interests and preferences. Audio markers may be selected for the user from a plurality of audio markers, based on the user specified interests and preferences. The user may also select particular audio markers. For example, user may select from a plurality of interest categories including but not limited to entertainment, historical, architecture, restaurants, bars, scenic and the like. In an aspect, an interface of the AR application may show the audio markers selected for the user on a map. In an aspect, the user may select audio markers on the map or from a list of audio markers before starting a trip.

In certain aspects, a user wearing audio headphones in accordance with aspects of the present disclosure may fix a direction of focus of the audio headphones to focus in a particular direction.

Figure 4A:
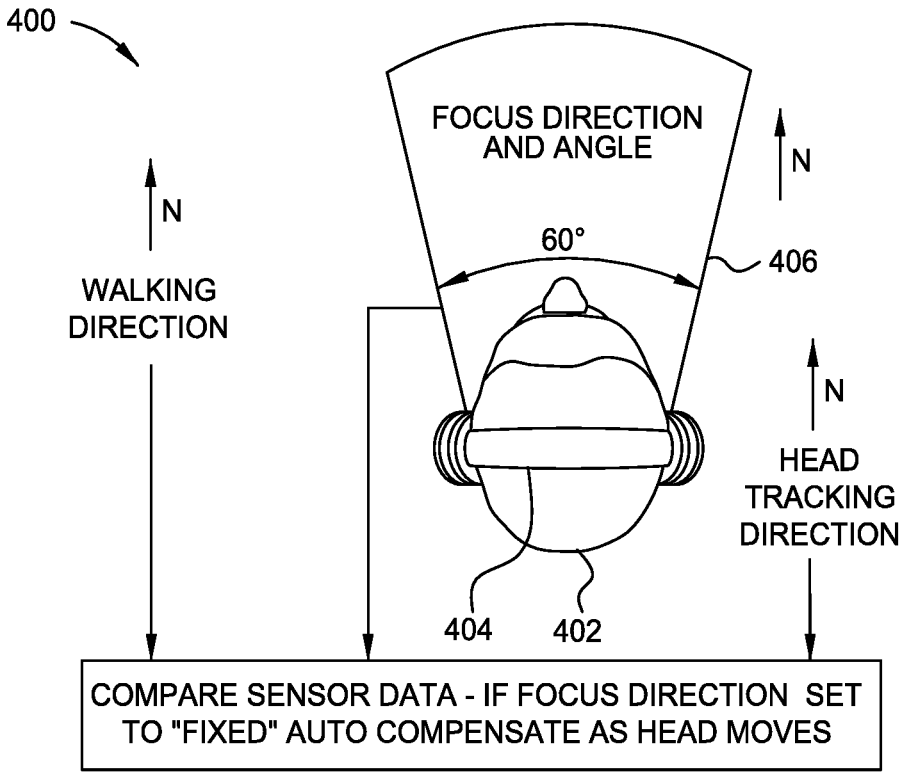
FIGS. 4A, 4B and 4C illustrate an example of a fixed directionality of focus, in accordance with certain aspects of the disclosure.
Figure 4B:
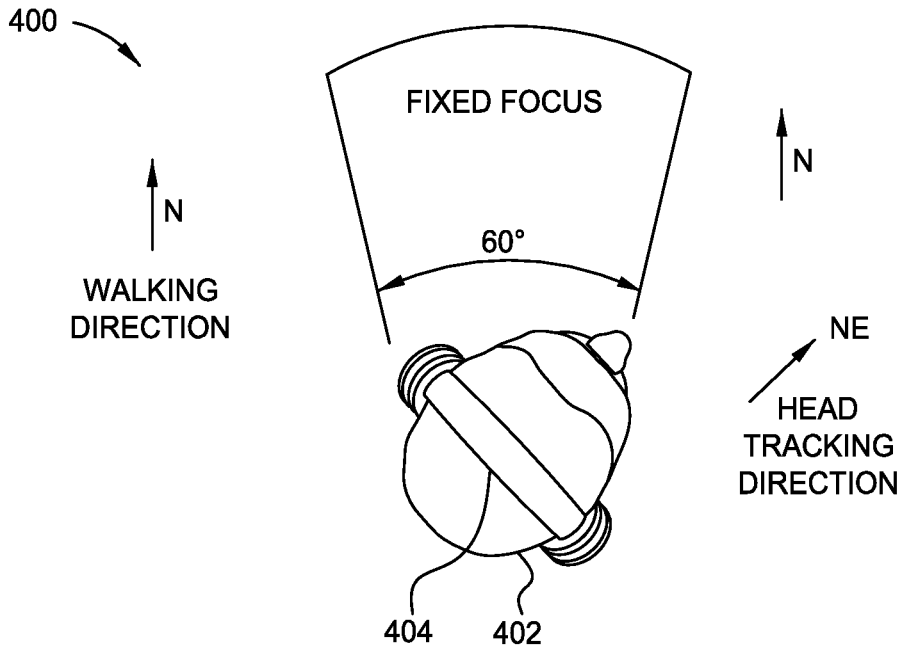
Figure 4C:
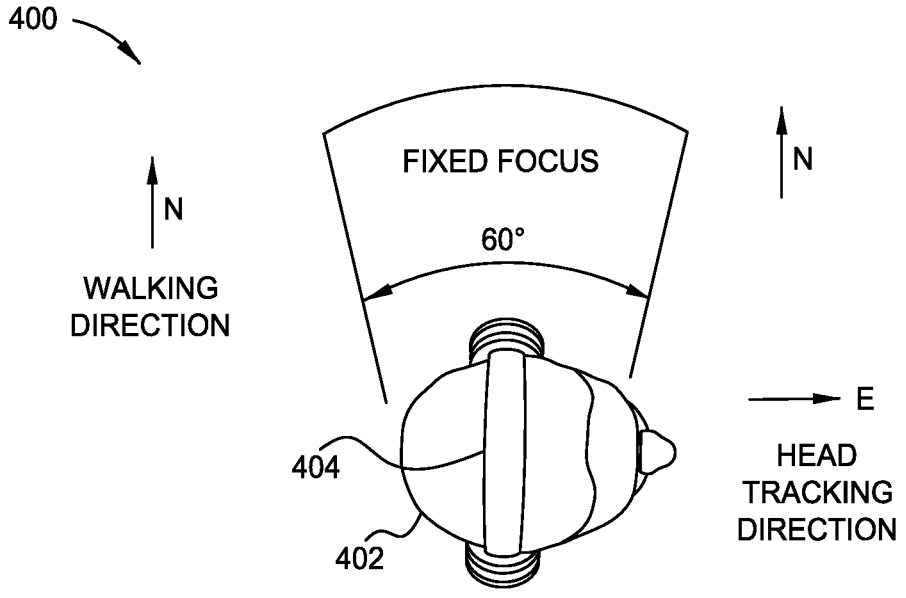

FIGS. 4A, 4B and 4C illustrate an example 400 of a fixed directionality of focus, in accordance with certain aspects of the disclosure.

As shown in FIG. 4A, a user 402 is wearing audio headphones 404 and facing in the northerly direction. For example, the user may be walking in the northerly direction and may have set a directionality of focus of the headphones 404 straight ahead relative to the headphones 404 to focus on sounds received in the direction the user is looking. The user may move his/her head around temporarily while still walking in the northerly direction. Since the directionality of focus is set to align straight ahead relative to the headphones 404, the focus changes as the user's head moves to focus in the direction the user is looking. This may not be desirable as the user may still want to listen to sounds from the direction the user is walking and may not want the directionality of focus to keep changing with temporary head movements.

In certain aspects, the user may set the direction of focus to align with a fixed direction (e.g., the user's walking direction) instead of a changing focus with the user's head orientation. As discussed above, the user's head orientation may be detected by way of head tracking using one or more sensors built into the headphones 404. As shown in FIG. 4A, the audio headphones 404 are focused in a 60° cone 406 centered around the northerly direction in which the user is initially looking. In an aspect, the user may set the initial northerly direction as a fixed direction using an AR application running on a portable device connected to the headphones 404.

In certain aspects, the headphones 404 continuously tracks the head orientation of the user and adjusts the direction of focus relative to the user's head to keep the focus locked on sounds emanating from the northerly direction. In an aspect, to implement the fixed focus, the headphones 404, the AR application, or a combination thereof may continuously compare the sensor data indicating the user's head orientation with the fixed northerly direction, and continuously adjust the direction of focus relative to the headphones 404 to stay aligned with the northerly direction.

As shown in FIGS. 4B and 4C, as the user's head orientation changes, the directionality of focus is adjusted to stay aligned to the northerly direction in which the user is walking.

An example application of the fixed directionality of focus may be directional hearing enhancement in which a user wearing the headphones in accordance with aspects of the present disclosure may direct the directionality of focus to align and fix towards a person or group of people, in order to improve audibility of voice(s). In an aspect, the user may use voice commands to quickly move a cone of focus from person to person. For example, the user may turn his/her head towards a person or group of people and say (e.g., using a voice interface) "help me hear this person/area" to move the focus cone to the desired person/area. In an aspect, the cone of focus may remain pinned to the person/area of interest even after the user has moved his/her head.

In certain aspect, it is desirable to use a narrow cone of focus to a speaker to allow for a more directed focusing. However, without locking the narrow cone of focus to the speaker, the user may keep losing focus to the speaker when the user moves his/her head during a conversation with the speaker. Thus, it is generally advisable to use a wider cone of focus (e.g., not less than 60°) to account for the minor head movements. In certain aspects locking a cone of focus to a speaker in accordance with aspects of the present disclosure allows using a narrower cone of focus to the speaker allowing for a more directed focusing, while avoiding the above stated problem.

Another example application of the fixed directionality of focus may include helping a driver or a front passenger in a car to more clearly hear a rear passenger. For example, the driver wearing the headphones in accordance with aspects of the present disclosure may lock a cone of focus towards the rear seats allowing the driver to clearly hear the rear passengers without a need to change his/her driving behavior.

It may be noted that, descriptions of aspects of the present disclosure are presented above for purposes of illustration, but aspects of the present disclosure are not intended to be limited to any of the disclosed aspects. Many modifications and variations will be apparent to those of ordinary skill in the art without departing from the scope and spirit of the described aspects.

In the preceding, reference is made to aspects presented in this disclosure. However, the scope of the present disclosure is not limited to specific described aspects. Aspects of the present disclosure may take the form of an entirely hardware embodiment, an entirely software embodiment (including firmware, resident software, micro-code, etc.) or an embodiment combining software and hardware aspects that may all generally be referred to herein as a "component," "circuit," "module" or "system." Furthermore, aspects of the present disclosure may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples a computer readable storage medium include: an electrical connection having one or more wires, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the current context, a computer readable storage medium may be any tangible medium that can contain, or store a program.

The flowchart and block diagrams in the Figures illustrate the architecture, functionality and operation of possible implementations of systems, methods and computer program products according to various aspects. In this regard, each block in the flowchart or block diagrams may represent a module, segment or portion of code, which comprises one or more executable instructions for implementing the specified logical function(s). In some alternative implementations the functions noted in the block may occur out of the order noted in the figures. For example, two blocks shown in succession may, in fact, be executed substantially concurrently, or the blocks may sometimes be executed in the reverse order, depending upon the functionality involved. Each block of the block diagrams and/or flowchart illustrations, and combinations of blocks in the block diagrams and/or flowchart illustrations can be implemented by special-purpose hardware-based systems that perform the specified functions or acts, or combinations of special purpose hardware and computer instructions.

What is claimed is:

1. A method for operating a wearable audio device, comprising:

detecting at least one point of interest in a vicinity of a user wearing the audio device;

improving audibility, in response to the detection, of sounds received in a direction of the at least one point of interest while attenuating sounds received in at least one other direction; and outputting at least the improved sounds for delivering by the audio device to at least one ear of the user, wherein the improved sounds are delivered by at least one speaker of the audio device to the at least one ear of the user.

2. The method of claim 1, wherein improving the audibility comprises focusing one or more microphones of the audio device in the direction of the at least one point of interest to receive the sounds emanating from the point of interest, while attenuating sounds in at least one unfocused direction.

3. The method of claim 1, wherein the detecting comprises:

receiving information regarding a first position of the user;

receiving information regarding a second position of the at least one point of interest; and determining, based on the received first and second positions, that the user is in the vicinity of the at least one point of interest.

4. The method of claim 1, further comprising:

receiving pre-recorded audio associated with the at least one point of interest, wherein the outputting further comprises outputting the pre-recorded audio for delivering by the audio device along with the improved sounds to the at least one ear of the user.

5. The method of claim 4, further comprising:

receiving configuration information configuring the outputting of the pre-recorded audio and the improved sounds; and outputting the pre-recorded audio and the improved sounds based on the configuration.

6. The method of claim 4, wherein the outputting comprises intermittently outputting the pre-recorded audio, wherein the improved sounds are outputted when the pre-recorded is not outputted.

7. The method of claim 4, wherein the outputting comprises outputting the improved sounds at a reduced volume when the pre-recorded audio is being outputted.

8. The method of claim 1, further comprising:

receiving head tracking information indicating a head position of the user, wherein at least a portion of the audio device is coupled to the head of the user and an orientation of the audio device changes with the head position of the user; and setting a direction relative to the audio device for the improving audibility of the sounds based on the received head tracking information.

9. The method of claim 8, wherein the setting comprises changing the direction relative to the audio device based on the head tracking information to maintain alignment with the direction of the point of interest.

10. The method of claim 1, further comprising:

receiving user preferences relating to a set of points of interests; and selecting, based on the user preferences, the at least one point of interest for the detecting.

11. A wearable audio device, comprising:

a transceiver configured to transmit and receive signals;

a set of microphones for receiving sound in an environment external to the audio device; and a processing unit configured to:

detect at least one point of interest in a vicinity of a user wearing the audio device; and improve audibility, in response to the detection, of a portion of the sound received in a direction of the at least one point of interest while fading out one or more remaining portions of the sound received in at least one other direction; and at least one speaker for delivering sounds to the ears of the user, wherein the improved sounds are delivered by the at least one speaker to at least one ear of the user.

12. The wearable audio device of claim 11, wherein the processing unit is configured to improve audibility of the portion of the sound by focusing the set of microphones in the direction of the at least one point of interest to receive the sounds emanating from the point of interest, while attenuating sounds in at least one unfocused direction.

13. The wearable audio device of claim 11, wherein the transceiver is configured to:

receive information regarding a first position of the audio device; and receive information regarding a second position of the at least one point of interest, and wherein the processing unit is configured to detect the at least one point of interest by determining, based on the received first and second positions, that the user is in the vicinity of the at least one point of interest.

14. The wearable audio device of claim 11, wherein the transceiver is configured to receive pre-recorded audio associated with the at least one point of interest, wherein the at least one speaker is configured to deliver the pre-recorded audio along with the improved sounds to the at least one ear of the user.

15. The wearable audio device of claim 11, wherein at least a portion of the audio device is coupled to the head of the user and an orientation of the audio device changes with a head position of the user, the audio device further comprising:

at least one sensor for tracking an orientation of the audio device, wherein the processing unit sets a direction relative to the audio device for the improving audibility of the sounds based on the tracking.

16. A wearable audio device comprising:

a set of microphones for receiving sound in an environment external to the audio device;

at least one processor configured to:

detect at least one point of interest in a vicinity of a user wearing the audio device;

improve audibility, in response to the detection, of sounds received in a direction of the at least one point of interest while fading out sounds received in at least one other direction;

receive pre-recorded audio associated with the at least one point of interest; and output the improved sounds and the pre-recorded audio for delivering by the audio device to at least one ear of the user; and a memory coupled to the at least one processor.

17. The wearable audio device of claim 16, wherein the at least one processor is configured to improve audibility of the sounds by focusing the set of microphones in the direction of the at least one point of interest to receive the sounds emanating from the point of interest, while attenuating sounds in at least one unfocused direction.

18. The wearable audio device of claim 16, wherein the at least one processor is configured to detect the at least one point of interest by:

receiving information regarding a first position of the user;

receiving information regarding a second position of the at least one point of interest; and determining, based on the received first and second positions, that the user is in the vicinity of the at least one point of interest.

19. The wearable audio device of claim 16, wherein the at least one processor is further configured to:

receive configuration information configuring the outputting of the pre-recorded audio and the improved sounds; and output the pre-recorded audio and the improved sounds based on the configuration.

20. The wearable audio device of claim 16, wherein the at least one processor is further configured to:

receive head tracking information indicating a head position of the user, wherein at least a portion of the audio device is coupled to the head of the user and an orientation of the audio device changes with the head position of the user; and set a direction relative to the audio device for the improving audibility of the sounds based on the received head tracking information.

* * * * *